US005130602A

United States Patent [19]

Verwimp

[11] Patent Number: 5,130,602

[45] Date of Patent: Jul. 14, 1992

[54] HIGH-PRESSURE GAS DISCHARGE LAMP

[75] Inventor: Frans J. D. Verwimp, Turnhout, Belgium

[73] Assignee: U.S. Philips Corporation, New York, N.Y.

[21] Appl. No.: 713,533

[22] Filed: Jun. 5, 1991

Related U.S. Application Data

[63] Continuation of Ser. No. 471,171, Jan. 26, 1990, abandoned.

[30] Foreign Application Priority Data

Feb. 1, 1989 [NL] Netherlands ..... 8900240

[51] Int. Cl.[5] ..... H01J 61/00

[52] U.S. Cl. ..... 313/240; 313/25; 313/284; 313/350; 313/356

[58] Field of Search ..... 313/25, 240, 283, 350, 313/356, 631, 15, 284

[56] References Cited

U.S. PATENT DOCUMENTS

| | | | |
|---|---|---|---|
| 4,002,940 | 1/1977 | Ekkelboom et al. | 313/346 R |
| 4,734,612 | 3/1988 | Sasaki et al. | 313/15 |
| 4,843,266 | 6/1989 | Szántó et al. | 313/25 |
| 4,910,427 | 4/1990 | Aelterman et al. | 313/356 |

FOREIGN PATENT DOCUMENTS

| | | | |
|---|---|---|---|
| 0035446 | 3/1980 | Japan | 313/25 |
| 0037701 | 3/1980 | Japan | 313/25 |

*Primary Examiner*—Donald J. Yusko
*Assistant Examiner*—Nimeshkumar D. Patel
*Attorney, Agent, or Firm*—Brian J. Wieghaus

[57] ABSTRACT

The high-pressure gas discharge lamp has within an outer envelope a discharge vessel and current supply conductors, which are connected via current lead-through conductors to electrodes within the discharge vessel. The current supply conductor is enveloped in part by an insulator. The lamp is resistant to shocks due to the fact that the insulator is laterally fixed to the outer envelope.

19 Claims, 1 Drawing Sheet

HIGH-PRESSURE GAS DISCHARGE LAMP

This is a continuation of application Ser. No. 07/471,171, filed Jan. 26, 1990, now abandoned.

BACKGROUND OF THE INVENTION

The invention relates to a high-pressure gas discharge lamps having a current-supply conductor enclosed by an insulator and extending proximate the inside wall of the outer envelope.

High pressure discharge lamps typically have an outer envelope sealed in a vacuum-tight manner and having a seal at a first end thereof, and a lamp cap provided with contacts, in which the first end of the outer envelope is fixed. A discharge vessel sealed in a vacuum-tight manner is arranged within the outer envelope and provided with an ionizable filling and with electrodes connected to a first and a second current lead-through conductor, respectively, which emanate from the discharge vessel near and remote from the first end of the outer envelope, respectively. A first and second current-supply conductors, are connected to respective contacts of the lamp cap and extend through the seal at the first end of the outer envelope to the first and the second current lead-through conductor, respectively. A part of the second current supply conductor is enveloped within the outer envelope by an insulator. Such a lamp is known, for example, from U.S. Pat. No. 4,002,940.

In high-pressure gas discharge lamps to be used in an optical system, endeavours are made to give the outer envelope the smallest possible transverse dimensions. As a result, minimal limitations are imposed on the design of the optical system. Small transverse dimensions of the outer envelope result in that the second current supply conductor extends within the outer envelope at a small distance from the outer envelope.

In certain high-pressure gas discharge lamps, it is necessary that a part of the second current supply conductor is surrounded by an insulator. This is the case if it must be prevented that small metal ions, such as ions of sodium, disappear from the filling due to the fact that U.V. radiation releases electrons from the second current supply conductor, which electrons are deposited on the discharge vessel. The negative charge on the discharge vessel is conducive to migration of sodium ions through the wall of the discharge vessel.

An insulator around the second current supply conductor may alternatively be necessary to enlarge the smallest distance between bare parts of the first and the second current supply conductor in order to reduce or exclude the risk of flash-over. This is the case in lamps in which a very high voltage is used, for example, of several kV to several tens of kV for re-igniting the lamp in the hot state after a lamp current interruption.

In a lamp in which the second current supply conductor extends within the outer envelope at a small distance therefrom, the insulator around the current supply conductor can be located at such a small distance from the outer envelope that the lamp is highly sensitive to shocks and that even during manipulation, for example packing, of the lamp the insulator is liable to break.

SUMMARY OF THE INVENTION

The invention has for its object to provide a lamp of the kind described in the opening paragraph, which has a construction more resistant to shocks.

According to the invention, this object is achieved in that the insulator is laterally connected or fixed to the outer envelope at a location other than its sealed end.

The connection may be established, for example, by means of an adhesive, for example a glass melting at a temperature lower than that of the outer envelope and of the insulator, such as lead borate glass, or a glue. Another possibility consists in indenting the outer envelope, for example providing it with indentations on either side of the insulator. With an indentation or indentations the insulator is then enclosed against the wall of the outer envelope. Alternatively, it is possible to fuse the outer envelope with the insulator.

By fixing the insulator to the outer envelope, it is achieved that the insulator and the outer envelope in the case of shocks or vibrations no longer can abut against each other at the area of the connection and at a certain distance therefrom. With the use of a second current supply conductor, which is surrounded by an insulator along a comparatively great length, a simple experiment can show whether it is desirable to secure said conductor at more than one point.

Embodiments of lamps having a glass insulator secured to the seal of the outer envelope, which are suitable to be ignited or re-ignited at a very high voltage, for example 50 kV, are shown in the drawing.

DESCRIPTION OF THE PREFERRED EMBODIMENTS

Figure 1:
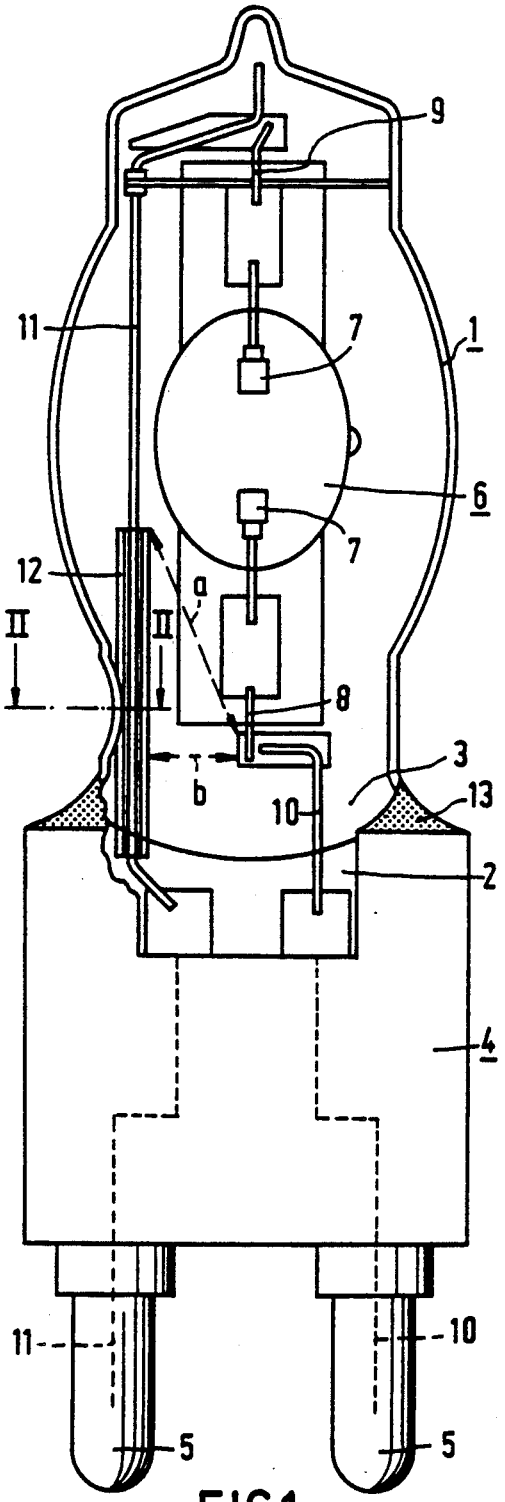
FIG. 1 is a side elevation, partly broken away, of a lamp.

In FIG. 1, the lamp has an outer envelope 1 of hard glass or glass having an $SiO_2$ content of at least 95% by weight, such as quartz glass, which is sealed in a vacuum-tight manner and has a pinched, or press, seal 2 at a sealed end 3 thereof. This end 3 is fixed (in the drawing by means of cement 13) in a lamp cap 4 of ceramic material carrying contacts 5. A discharge vessel 6 of glass having an $SiO_2$ content of at least 95% by weight, such as quartz glass, sealed in a vacuum-tight manner, has an ionizable filling, for example bromide, of a rare earth metal, such as dysprosium, holmium or thulium and mercury bromide, mercury iodide, caesium iodide, mercury and argon/krypton at a pressure of 50 mbar. Electrodes 7 are arranged in the discharge vessel 6 and these electrodes are connected to a first conductive lead-through 8 and a second conductive lead-through 9, which emanate from the discharge vessel near and remote from the first end 3 of the outer envelope 1, respectively. By application of a potential across lead-throughs 8, 9 the discharge vessel is energized to emit light.

A first current supply conductor 10 and a second current supply conductor 11 are connected to a respective contact 5 at the lamp cap 4 and extend through the press seal 2 at the first end 3 to the first and second conductive lead-through 8 and 9, respectively. A part of the second current supply conductor 11 is enveloped within the outer envelope 1 by an insulator 12. The insulator in the drawing is a tube of glass, for example of glass having an $SiO_2$ content of at least 95% by weight, such as quartz glass. The insulator 12 is anchored in the seal 2 in that it is fused therewith. The insulator 12 may alternatively be secured to the seal 2 by means of a low melting-point glass, such as lead borate glass.

The insulator 12 is fixedly connected also laterally to the outer envelope 1 at the neck portion, which is located between the sealed end 2 and the bulbous portion in which the discharge vessel 6 is arranged.

Figure 2:
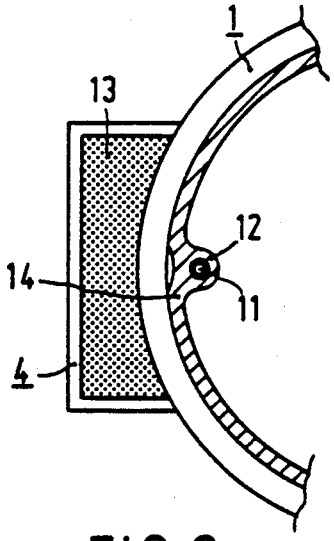
FIG. 2 is a sectional view taken on II—II in FIG. 1.

As is shown in FIG. 2, the outer envelope has a fused area 14 with the insulator 12, which without this fused area would extend at a very small distance from the outer envelope and would be destroyed when abutting against it. Due to the fused area, a rigid assembly is obtained. Due to the presence of the insulator 12, the smallest distance (a) between bare parts of the current supply conductors 10, 11 is more than twice the smallest distance between said bare parts (b) without the use of the insulator. Flash-over during ignition or re-ignition at, for example, 50 kV is thus prevented.

Figure 3:
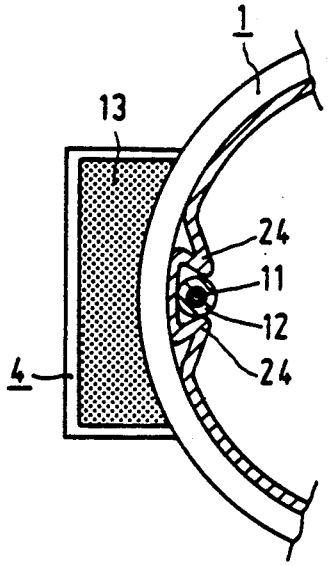
FIG. 3 shows a variation of FIG. 2.

FIG. 3 shows an embodiment, in which the outer envelope 1 has indentations 24, which partially enclose the insulator 12 to fix the insulator to the envelope 12.

I claim:

1. A high-pressure gas discharge lamp, comprising an outer envelope sealed in a vacuum-tight manner and having a sealed end thereof, a lamp cap in which said sealed end of said outer envelope is fixed, said lamp cap having a pair of lamp contacts;

a discharge vessel arranged within said outer envelope and sealed in a vacuum-tight manner, said discharge vessel comprising an ionizable filling, a pair of discharge electrodes between which a discharge is maintained during lamp operation, and first and second conductive lead-throughs which emanate from the discharge vessel near and remote from said sealed end of the outer envelope, respectively;

first and second current-supply conductors each connected to a respective lamp contact and extending through said sealed outer envelope end and being connected a respective one of to said first and second conductive lead-throughs, said second current conductor extending the length of said discharge vessel and being connected to said second lead-through at an end portion of said second current conductor; and a tubular insulator enveloping a part of said second current supply conductor within the outer envelope at a location between said sealed end and said remote end portion thereof, characterized in that: said insulator is laterally fixed to the outer envelope at a location offset from said sealed end.

2. A high-pressure discharge lamp as claimed in claim 1, characterized in that said insulator is fused with said outer envelope.

3. A high-pressure discharge lamp as claimed in claim 1, characterized in that said outer envelope has opposing indentations at least partially enclosing said insulator for fixing said insulator to said outer envelope.

4. A high-pressure discharge lamp as claimed in claim 3, characterized in that said insulator is secured to said sealed end of said outer envelope.

5. A high-pressure discharge lamp as claimed in claim 2, characterized in that said insulator is secured to said sealed end of said outer envelope.

6. A high-pressure discharge lamp as claimed in claim 1, characterized in that said insulator is secured to said sealed end of said outer envelope.

7. In a high pressure gas discharge lamp having an outer envelope with a sealed end, a discharge vessel arranged within said outer envelope and energizable for emitting light, means for energizing said discharge vessel to emit light, said means comprising a current-supply conductor extending through said sealed end and connected to said discharge vessel, said current-supply conductor extending proximate a portion of said outer envelope at a location offset from said sealed end, and a tubular insulator enveloping part of said current-supply conductor, said current-supply conductor being mounted such that said insulator is subject to impacts against said outer envelope portion when said lamp is subjected to shock, the improvement comprising:

said tubular insulator being laterally fixed to said outer envelope portion offset from said sealed end.

8. In a high pressure gas discharge lamp according to claim 7, wherein said insulator is fused to said outer envelope portion.

9. In a high pressure discharge lamp according to claim 7, wherein said outer envelope portion has opposing indentations at least partially enclosing said insulator for fixing said insulator against said outer envelope portion.

10. In a high pressure discharge lamp according to claim 9, wherein said sealed end is a press seal sealing said envelope in a gas-tight manner, and an end of said insulator is fixed in said press seal.

11. In a high pressure discharge lamp according to claim 8, wherein said sealed end is a press seal sealing said envelope in a gas-tight manner, and an end of said insulator is fixed in said press seal.

12. In a high pressure discharge lamp according to claim 7, wherein said sealed end is a press seal sealing said envelope in a gas-tight manner, and an end of said insulator is fixed in said press seal.

13. A high pressure gas discharge lamp, comprising:

an outer envelope having a light-transmissive wall and a sealed end sealing said envelope wall in a gas tight manner;

a discharge vessel arranged within said outer envelope and energizable for emitting light;

a rigid tubular insulator within said outer envelope fixed to said envelope wall at a location offset from said sealed end; and means for energizing said discharge vessel to emit light, said means comprising a frame conductor extending through said sealed end portion and said tubular insulator and connected to said discharge vessel.

14. A high pressure gas discharge lamp according to claim 13, wherein:

said outer envelope has a bulbous portion in which said discharge vessel is substantially disposed, and a neck portion between said bulbous portion and said sealed end; and said tubular insulator is fixed to said neck portion of said outer envelope.

15. A high-pressure discharge lamp as claimed in claim 14, characterized in that said insulator is fused with said neck portion.

16. A high-pressure discharge lamp as claimed in claim 15, characterized in that said insulator is also secured to said sealed end of said outer envelope.

17. A high-pressure discharge lamp as claimed in claim 14, characterized in that said neck portion has indentations at least partially enclosing and contacting said insulator for fixing said insulator to said outer envelope.

18. A high-pressure discharge lamp as claimed in claim 13, characterized in that said insulator is also secured to said sealed end of said outer envelope.

19. A high-pressure discharge lamp as claimed in claim 14, characterized in that said insulator is also secured to said sealed end of said outer envelope.

* * * * *